United States Patent [19]

Hofmann

[11] 4,208,752

[45] * Jun. 24, 1980

[54] CLEANING APPARATUS FOR SUBMERGED SURFACES

[76] Inventor: Helmut J. Hofmann, 1310 Golden Oaks, corner Claim and Yettah Sts., Hillbrow, Johannesburg, Transvaal Province, South Africa

[ * ] Notice: The portion of the term of this patent subsequent to Jan. 9, 1996, has been disclaimed.

[21] Appl. No.: 956,151

[22] Filed: Oct. 31, 1978

Related U.S. Application Data

[63] Continuation-in-part of Ser. No. 827,185, Aug. 23, 1977, Pat. No. 4,133,068.

[30] Foreign Application Priority Data

| | | | |
|---|---|---|---|
| Aug. 23, 1976 | [ZA] | South Africa | 76/5024 |
| Nov. 8, 1976 | [ZA] | South Africa | 76/6672 |
| May 30, 1977 | [ZA] | South Africa | 77/3262 |

[51] Int. Cl.[2] ..... E04H 3/20

[52] U.S. Cl. ..... 15/1.7; 15/404

[58] Field of Search ..... 15/1.7, 404, 416, 419

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |

*Primary Examiner*—Edward L. Roberts

*Attorney, Agent, or Firm*—Sughrue, Rothwell, Mion, Zinn and Macpeak

[57] ABSTRACT

An apparatus for cleaning swimming pools in a stepwise movement over the pool walls comprises a balanced operating head having an inlet and an outlet, the outlet adapted to be swivelably connected to a longitudinally resilient and flexible suction hose. The inlet axis is inclined at an angle of between thirty degrees and sixty degrees to that of the outlet. A passage extends through the head from inlet to outlet, and an oscillatable valve in the head is adapted to alternately open and close said passage. A baffle plate is disposed in the head between the inlet and valve to form a restricted suction connection between inlet and outlet around the valve when the passage is closed, the connection being as restricted as practical commensurate with proper valve movement.

5 Claims, 2 Drawing Figures

CLEANING APPARATUS FOR SUBMERGED SURFACES

CROSS REFERENCE TO RELATED APPLICATION

This application is a Continuation-In-Part of my earlier application Ser. No. 827,185 filed Aug. 23, 1977 now U.S. Pat. No 4,133,068.

BACKGROUND OF THE INVENTION

This invention relates to an apparatus for cleaning submerged surfaces, and more particularly to the type of equipment known as "suction sweepers" for swimming pools.

Suction sweepers are almost universally used for cleaning submerged surfaces such as swimming pools and the like. Many forms of sweepers have been designed and produced, and some of these have included features which make them more or less self-propelled while suction is applied through the equipment. Alternatively, this desirable self-propelling action has been obtained by applying an auxiliary fluid flow to the cleaning head.

One effective and simple type of cleaning equipment has been disclosed and relies essentially on cutting off the suction to the operating head of the equipment in a manner which will cause the liquid in the suction pipe to cause the latter to flex and move the head along the surface to be cleaned.

In another form of equipment the suction pipe is connected to the common outlet of a pair of rigid passages which are connected through valve seats to the suction inlet to the equipment. A flapper valve is provided in the operating head which, while suction is applied through the equipment, oscillates automatically to alternately close off the passages to the suction pipe. Because of the particular arragement of the passages and the valve relative to the inlet opening to the apparatus the action of the valve is such that by striking the valve seats the equipment experiences a driving force that has a net componet in a direction parallel to the surface being cleaned. Also, flow is alternately suddenly stopped and accelerated against the inertia of the liquid in the two passages, a further impulse force to move the equipment over the surface to be cleaned is generated.

The equipment is provided with balancing and stabilizing features which ensure that it will remain properly orientated when submerged and also prevent it from climbing above the level of the liquid submerging the surface to be cleaned.

The former apparatus tends to move slowly over the surface to be cleaned while the latter with its rigid passages is cumbersome and bulky.

It has been found that the slow operation of the former type of equipment is due more to the type of equipment developed to effect cutting off of the suction and consequently flow through the operating head than to the principle of causing flexing of the suction pipe. It has further been found that an oscillatable valve used to cut off the flow, gives very satisfactory results in practice.

As examples of such prior art, see U.S. Pat. Nos. 3,803,658 and 4,023,227.

SUMMARY OF THE INVENTION

It is the object of the present invention to provide equipment which will effectively clean submerged surfaces and which is neat and compact and which can move over the surface to be cleaned at a rate of up to about 18 feet per minute.

The type of equipment above described has a random movement over the surface to be cleaned and therefore to be effective must move at a useful speed but also not move fast enough to disturb the dirt on the surfaces to such an extent that it will not be sucked through the equipment to be filtered from the liquid.

According to this invention there is provided apparatus for cleaning submerged surfaces comprising:

a balanced operating head having an inlet and an outlet defining respective inlet and outlet axes, the outlet adapted to be swivelably connected to a longitudinally resilient and flexible suction hose, the inlet axis being inclined at an angle of between thirty degrees and sixth degrees to that of the outlet, a passage through the head from inlet to outlet, an oscillatable valve in the head adapted to alternately open and close said passage, a baffle plate in the head between the inlet and valve to form a restricted suction connection between inlet and outlet around the valve and when the passage is closed, the connection being as restricted as practical commensurate with proper valve movement, and the valve being shaped so that liquid flow through the head will cause automatic oscillation thereof between terminal positions.

The invention also provides for the valve to operate between parallel surfaces provided in the head, for there to be a pair of valve members which oscillate in opposite directions, and for the balancing to be provided by a bouyancy member and a movable weight.

Still further features of this invention provide for the inlet to the head to provided though openings allowing flow at right angles to, as well as axially through, the inlet.

BRIEF DESCRIPTION OF THE DRAWINGS

Many other features of this invention will become apparent from the following description of a preferred embodiment which is made with reference to the accompanying drawings in which.

DETAILED DESCRIPTION OF THE PREFERRED EMBODIMENT

This form of the invention is designed as a swimming pool cleaning apparatus.

Figure 1:
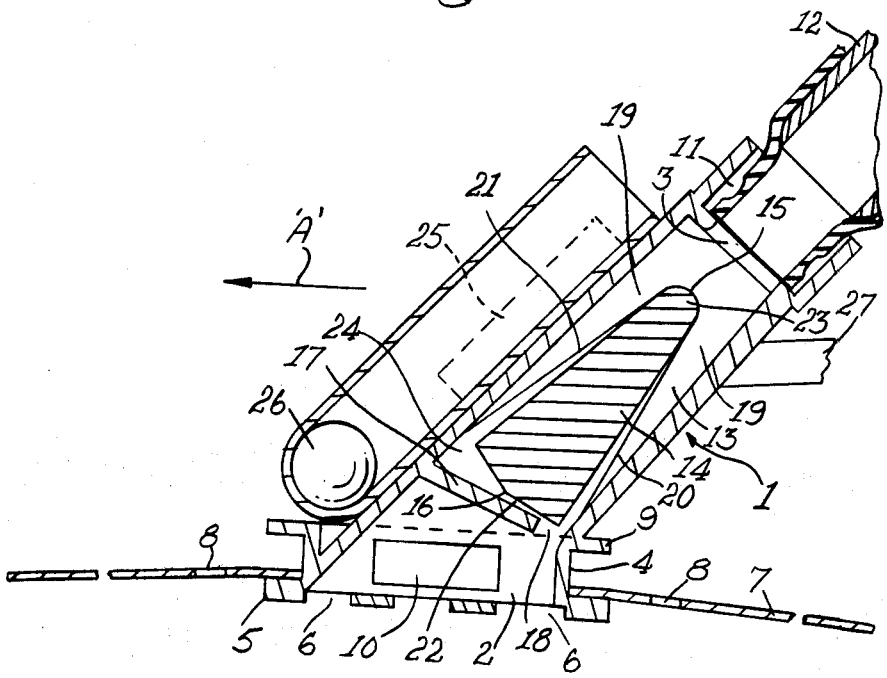
FIGS. 1 and 2 show part sectional front and side elevations, respectively, of an apparatus according to the invention.
Figure 2:
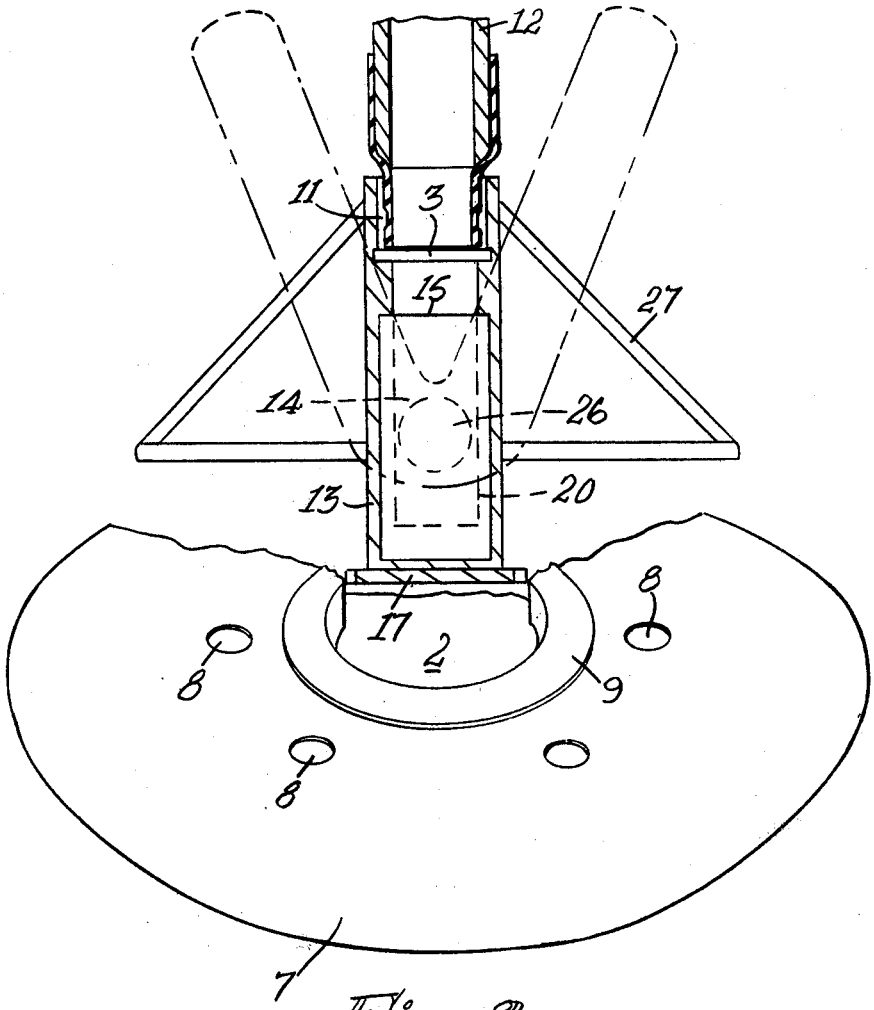

Referring to FIGS. 1 and 2, the apparatus consisting of an operating head 1 which basically is of rectangular transverse cross-section having circular inlet 2 and outlet 3 openings. The axis of the inlet 2 is offset from that of the outlet 3 at an angle of preferably forty-five degrees. Manufacturing techniques may require that this angle be varied, but it is desirable that it be kept as close to forty-five degrees as possible.

The inlet 2 is made as a cylindrical part 4, the lower part 5 of which is adapted to contract the surface to be cleaned. Openings 6 through the wall of part 5 ensure that water may flow into the inlet.

A flexible annular disc 7 is fitted onto the cylindrical part 4 and has apertures 8 therethrough so that water may flow therethrough and through openings 6 when suction is applied to draw water through the head. This limits the force with which the head is held against the surface to be cleaned. A peripheral flange 9 is spaced apart from the lower part 5 and serves to retain the disc 7 in position.

Most of the flow induced by suction takes place through ports 10 in the wall of the cylindrical part as is more fully described below.

The outlet 3 has a swivelable fitting 11 incorporated therein so that the head can be attached to a longitudinally resilient suction pipe 12 which is also flexible.

An oscillatable valve 14 is located within the head 1 between the inlet 2 and outlet 3 so that it may open or close a passage 13 through the head between the inlet and outlet. The valve 14 is of substantially triangular cross-section so that it may oscillate about its apex 15 adjacent the outlet 3. The base of the valve 14 is slightly peaked as indicated at 16 so that it may move over and co-operate with a partition member 17 located in the inlet end of the head 1 when water is caused to flow through the opening 18 into the head 1.

On the side of the valve opposite the flow passage 13 through the head is a suction communication which is designed so that there is as restricted an opening between inlet and outlet of the head as is commensurate with the proper operation of valve 14. Water flow through the suction communication is therefore greatly reduced compared to that through the passage 13. The suction communication is adapted to be shut off when the flow passage is open and is only open for a brief period when the valve 14 closes the flow passage. The shape and size of the valve 14 in the head together with the location of the partition member 17 constricts the suction communication to a size which prevents appreciable liquid flow therethrough.

Internal formations indicated at 19 are provided in the head 1 to constrain the movement of the valve 14 in the head and form valve seats 20 and 21 to close off the flow passage through the head 1.

The spape of the base of valve 14 providing peak 16 enables the space 22 between the valve and member 17 to remain substantially constant as the valve moves between its terminal positions and is also balanced.

The pivot point 23 of the valve 14 is located on the opposite side of the axis of the outlet 3 to the opening 18 so that it operates partially in a chamber 24 in the head 1 offset from the axis of outlet 3.

The valve 14 has a clearance between the sides of the body adjacent which it oscillates.

With the construction above set forth it has been found that when the head is submerged and a swimming pool suction filter applied to the pipe 12 the flow of water causes the valve to oscillate between its two terminal positions. In one such position the flow is substantially full and direct through opening 18 and passage 13 to outlet 3, while in the other there is maximum reduction in liquid flow through the head.

This results in use in an intermittent cut off flow through the head as the valve 14 oscillates between its terminal positions, and this in turn causes pulsations which result in longitudinal contractions and relaxations in the longitudinally resilient suction pipe from the head to the outlet from the swimming pool to its filter unit. In consequence of these contractions and relaxations and a simultaneous reduction and increase of the force applied to hold the disc 7 against the surface to be cleaned, a step by step movement of the head takes place over the surface to be cleaned.

The movement is automatic but random and to control this a bouyancy chamber 25 is provided. This will preferably be provided with foamed polystyrene flotation material. This chamber ensures that while the head will sink onto the surface to be cleaned it will nevertheless be correctly orientated thereto.

Also because the apparatus can operate on vertical walls it is necessary to provide suitable counterbalancing to prevent the head from climbing above the water level and allowing air to be drawn through the system. This can be easily effected in a known manner by having a freely movable weight 26 in a Vee-shaped guide attached to the head across the width thereof. It may be fitted to either the upper or lower surface of the head.

To prevent the apparatus from driving itself into positions where it cannot move, a flexible pointed guide 27 in the form of an open triangle of resilient plastics material is fitted to project from the head in the opposite direction to arrow "A", which is the direction of normal movement of the apparatus.

In use all that is necessary is for the swimming pool suction filter equipment to be connected to the head through longitudinally resilient and flexible piping and the head placed on the floor. It will then move randomly over the floor and, if the sides and bottom of the pool do not meet too sharply, also the sides of the pool. As the disc 7 moves over the floor it loosens any dirt thereon which is sucked through ports 10 and through the head into the filter. It can be allowed to operate whenever the filter is operated and requires no attention.

It will be appreciated that the embodiment has been described with the valve oscillating in a plane which is vertical to the surface to be cleaned. It is, of course, possible to have the valve work in a plane at right angles to this vertical plane and also to make other modifications to the constructions without departing from the scope of this invention.

The apparatus will preferably be moulded in plastics material, and polypropylene has been found suitable for use in the manufacture of the valves.

What is claimed is:

1. Apparatus for cleaning submerged surfaces, comprising:
   (a) a balanced operating head having an inlet and an outlet defining respective inlet and outlet axes,
   (b) the outlet adapted to be swivelably connected to a longitudinally resilient and flexible suction hose,
   (c) the inlet axis being inclined at an angle of between thirty degrees and sixty degrees to that of the outlet axis,
   (d) a passage through the head from inlet to outlet,
   (e) an oscillatable valve in the head adapted to alternately open and close said passage,
   (f) a baffle plate in the head between the inlet and the valve to form a restricted suction connection between the inlet and outlet around the valve when the passage is closed, the connection being as restricted as practical commensurate with proper valve movement, and
   (g) the valve being shaped so that liquid flow through the head will cause automatic oscillation thereof between terminal positions.

2. Apparatus as claimed in claim 1 in which parallel surfaces are formed in the head to guide the movement of the valve.

3. Apparatus as claimed in claim 1 in which the inlet to the head is formed as a cylindrical part having openings into one end and through the side wall of this part.

4. Apparatus as claimed in claim 3 in which an annular flexible disc with apertures therethrough is located on the cylindrical part.

5. Apparatus as claimed in claim 4 having a bouyancy chamber and movable balance weight associated therewith.

* * * * *